US007718587B2

(12) United States Patent
Schmidt, IV

(10) Patent No.: US 7,718,587 B2
(45) Date of Patent: May 18, 2010

(54) COMPOSITION AND METHOD FOR LUBRICATING CONVEYOR TRACK

(75) Inventor: William Charles Schmidt, IV, Hamilton, OH (US)

(73) Assignee: Lynx Enterprises, Inc., Fairfield, OH (US)

( * ) Notice: Subject to any disclaimer, the term of this patent is extended or adjusted under 35 U.S.C. 154(b) by 483 days.

(21) Appl. No.: 10/832,169

(22) Filed: Apr. 26, 2004

(65) Prior Publication Data

US 2005/0239665 A1 Oct. 27, 2005

(51) Int. Cl.
*C10M 173/02* (2006.01)
*C10M 137/10* (2006.01)
*C10M 169/04* (2006.01)

(52) U.S. Cl. ..... 508/431; 508/433; 508/440; 508/505

(58) Field of Classification Search ..... 508/431, 508/433, 440, 505
See application file for complete search history.

(56) References Cited

U.S. PATENT DOCUMENTS

| | | | | |
|---|---|---|---|---|
| 3,718,588 | A | 2/1973 | Bellos et al. | |
| 4,521,321 | A | 6/1985 | Anderson et al. | |
| 4,758,359 | A * | 7/1988 | Kirk et al. | 508/162 |
| 4,765,917 | A * | 8/1988 | Otaki et al. | 508/121 |
| 4,859,351 | A | 8/1989 | Awad | |
| 4,944,889 | A | 7/1990 | Awad | |
| 5,001,114 | A | 3/1991 | McDaniel, Jr. | |
| 5,062,979 | A | 11/1991 | Scharf et al. | |
| 5,080,814 | A | 1/1992 | Awad | |
| 5,352,376 | A * | 10/1994 | Gutzmann | 508/216 |
| 5,389,162 | A | 2/1995 | Endou et al. | |
| 5,391,308 | A | 2/1995 | Despo | |
| 5,534,643 | A | 7/1996 | Endou et al. | |
| 5,925,601 | A * | 7/1999 | McSherry et al. | 508/425 |
| 6,090,761 | A * | 7/2000 | Butler et al. | 508/486 |
| 6,525,005 | B1 | 2/2003 | Kravitz et al. | |
| 6,576,298 | B2 | 6/2003 | Bennett et al. | |
| 6,627,590 | B1 | 9/2003 | Sherry et al. | |
| 6,667,283 | B2 | 12/2003 | Kravitz et al. | |
| 6,677,280 | B2 | 1/2004 | Kupper et al. | |
| 2002/0006881 | A1 | 1/2002 | Kravitz et al. | |
| 2002/0051850 | A1 | 5/2002 | Bennett et al. | |
| 2004/0053793 | A1 | 3/2004 | Li et al. | |

FOREIGN PATENT DOCUMENTS

| | | |
|---|---|---|
| EP | 0 137 057 A1 | 4/1985 |
| EP | 0 293 820 A2 | 12/1988 |
| JP | 5 287 292 A2 | 11/1993 |
| JP | 7 034 079 | 2/1995 |
| WO | WO 92/13048 | 8/1992 |
| WO | WO 96/02616 | 2/1996 |

OTHER PUBLICATIONS

US 5,863,871, 01/1999, Besse et al. (withdrawn)

* cited by examiner

*Primary Examiner*—Anhtuan T Nguyen
*Assistant Examiner*—Amy T Lang
(74) *Attorney, Agent, or Firm*—Hasse & Nesbitt LLC; Donald E. Hasse

(57) ABSTRACT

A lubricant composition is provided for use in lubricating a conveyor track for bottles, cans, kegs and other containers for beverages and foodstuffs. The composition comprises a phosphate ester of the formula $R_1$—$(OCH_2CH_2)_n$—O—P(O)$(OH)_2$ where n is in the range of from 0 to 10, and $R_1$ is a $C_9$ to $C_{20}$ saturated or unsaturated alkyl group or a mixture of such alkyl groups; and water. The composition has a pH of from about 1 to about 3.5. The composition optionally further comprises a biocidal agent, an acid, and a synthetic surfactant. Also disclosed is a method for lubricating a conveyor track by applying an effective amount of such a lubricating composition.

16 Claims, No Drawings

COMPOSITION AND METHOD FOR LUBRICATING CONVEYOR TRACK

TECHNICAL FIELD

The present invention relates to a lubricant composition, and more specifically to compositions for use in lubricating the tracks that convey bottles, cans, kegs and similar containers for beverages and other foodstuffs from one station to another in a packaging plant. The invention also relates to a method for lubricating a conveyor track by applying an effective amount of such a lubricating composition to the track.

BACKGROUND OF THE INVENTION

Beverages (e.g., beer, soft drinks, juice drinks, water, dairy products) are sold in a variety of containers such as glass bottles, plastic bottles and containers, aluminum cans, and waxed carton packs. These containers are conveyed through a number of stations in a plant where they are filled with the desired beverage, sealed and labeled. The containers are conveyed from one station to another by a track. The conveyor track is usually made of stainless steel or plastic when the containers are glass bottles, aluminum cans, or a plastic material such as polypropylene or an acetal resin. The conveyor track must be lubricated and cleaned so that the track can continue to move even when the containers on the track are temporarily prevented from advancing such as when a container falls over or gets jammed. If the conveyor track is not properly lubricated, containers may fall over and disrupt the efficient operation of the plant. Critical areas of the conveyor track that typically require lubrication are at the in-feed and discharge points of the rinser, filler, seamer, pasteurizer, and labeler.

Lubricant compositions used for lubricating and cleaning conveyor tracks are generally alkaline based on fatty acids, fatty amines, or phosphate esters. Fatty acid soaps are effective lubricants, but can cause excessive foaming when the conveyor track is moving at high speeds. Moreover, such compositions typically have a high pH (e.g., above about 8). When an acidic beverage (e.g., beer, a soft drink, or orange juice) spills or is rinsed off the container onto the conveyor track, it contacts the fatty acid soap and forms a precipitate on the floor or conveyor track. The precipitated soap is slippery, and can be a source of microbial growth and contamination, particularly when beverage spills occur. Some lubricant compositions are also aggressive to the coloring pigments used to label the surfaces of the containers, particularly steel and aluminum cans used in the beverage industry. The printed matter on the surface of the container may leach into the lubricating composition and fade or distort the printing, making the containers unacceptable for use.

Thus, there is a continuing need for an effective, non-soap based lubricant composition for conveyor tracks that has biocidal properties and does not leach the printed matter on containers transmitted on the conveyor track.

SUMMARY OF THE INVENTION

The present invention relates to a lubricant composition for use in lubricating a conveyor track, said composition comprising:

(a) from about 1% to about 50% by weight of a phosphate ester of the formula $$R_1—(OCH_2CH_2)_n—O—P(O)(OH)_2$$

wherein n is from 0 to about 10, and $R_1$ is a $C_9$ to $C_{20}$ saturated or unsaturated alkyl group or a mixture of such alkyl groups; and (b) water;

said composition having a pH of from about 1 to about 3.5.

The invention also relates to a method for lubricating a conveyor track by applying an effective amount of such a lubricating composition to the track.

DETAILED DESCRIPTION OF THE INVENTION

The lubricant compositions of the invention comprise from about 1% to about 50% by weight of a phosphate ester of the formula $$R_1—(OCH_2CH_2)_n—O—P(O)(OH)_2$$

wherein n is from 0 to about 10, and $R_1$ is a $C_9$ to $C_{20}$ saturated or unsaturated alkyl group or a mixture of such alkyl groups.

In the phosphate ester, the value for n may be integer or non-integer. Non-integer values may arise where mixtures of the esters are used. Typically, n is from 0 to about 5 . In some embodiments, n is from about 2 to about 4, e.g., n is about 3.

Phosphate esters useful herein are described in more detail in EP-A-0137057. Such phosphate esters include those of general formula described above in which $R_1$ is selected from the group consisting of (i) linear saturated primary $C_9$ to $C_{18}$ alkyl groups, e.g., linear saturated primary $C_9$-$C_{15}$ alkyl groups, (ii) linear partially unsaturated primary $C_9$ to $C_{20}$ alkyl groups, and (iii) a mixture of linear primary $C_9$ to $C_{20}$ alkyl substituents, saturated or partially unsaturated, wherein the average length of the alkyl substituent is $C_{13}$ to $C_{18}$.

According to EP-A-0137057, the presence of the ethoxy groups in the chain of the phosphate ester increases the dispersibility of the ester in water but at some sacrifice in lubricity. Thus, while the lubricant performance of a typical monophosphate ester increases with the length of the alkyl chain, saturated alkyl groups longer than $C_{15}$ tend to be too insoluble to be easily formulated in the absence of some degree of ethoxylation. Increasing the ethylene oxide content increases solubility but reduces lubricating ability.

Specific phosphate esters useful in the present invention include those of above general formula where $R_1$ is $C_{10}$-$C_{15}$ and n is 0 or 3; those where $R_1$ is $C_{12}$ to $C_{15}$ and n=0, 2.25, or 3; and oleyl phosphate esters of general formula (I) in which $R_1$ is $CH_3(CH_2)_7CH{=}CH(CH_2)_7CH—$ and n is 2 or from 8 to 9.

In one embodiment, the phosphate ester is present as a mixture in which $R_1$ is a mixture of $C_9$ to $C_{15}$ saturated alkyl groups. An example of this phosphate ester is sold under the trade name Phospholan PBD-3 by Akros (formerly Lankro) Chemicals in which $R_1$ is $C_{12}$ to $C_{15}$ and n is 3 . This particular product contains about 65 to 70% by weight of phosphate ester, of which about 55 to 60% by weight is the monoester. In another embodiment, the phosphate ester is sold under the trade name Burcofac PA-1150, which is a free acid of an organic phosphate ester based on a $C_9$ to $C_{14}$ linear primary alcohol, available from Burlington Chemical Company, Inc., Burlington, N.C.

The phosphate ester may be present in a concentrated lubricant composition in amounts of from about 1% to about 50% by weight, based on the total weight of the composition. The phosphate ester is typically present in an amount ranging from about 2% to about 40%, more typically from about 5% to about 30%, e.g., from about 10% to about 20%, by weight, based on the total weight of the composition.

The composition further comprises water, usually soft or softened water, although water hardness typically does not affect the composition. A concentrated composition typically comprises from about 10% to 90%, more typically from about 20% to about 80%, e.g., from about 40% to about 70%, by weight of water. Any conventional formulation technique may be used to make up the composition, and the components can generally be added to the aqueous composition in any order with mixing.

The composition of the invention has a pH of from about 1 to about 3.5, typically from about 1 to about 3, more typically from about 1.5 to about 2.5 . Such acidic compositions do not form precipitates, which can be slippery or a source of microbial growth, when contacted by acidic beverages washed from or spilled from containers moving on the conveyor track. Any suitable acid may be included in the composition provided the pH is in the above range. However, the composition typically contains from about 1% to about 20%, more typically from about 2% to about 15% (e.g., from about 3% to about 10%) of an acid. Phosphoric acid is particularly useful in the compositions herein. Other acids such as short-chain (e.g., $C_1$ to $C_6$, substituted or unsubstituted) carboxylic acids, such as citric, acetic or glycolic acid, may be used in place of or in addition to phosphoric acid. The pH of the composition typically affects its lubricity when the product is diluted during use.

The composition of the invention typically also contains a biocidal agent such as an alkali metal, e.g., sodium or potassium, benzoate, or a quaternary ammonium compound such as disclosed in WO 96/02616, or the sanitizing agents disclosed in U.S. Pat. No. 5,925,601, both incorporated herein by reference. In one embodiment, the biocidal agent is sodium or potassium benzoate and the pH of the composition, even when diluted during use in the plant, is less than about 3.6 so that the benzoate effectively kills or controls yeast and/or mold. The biocidal agent is typically present in an amount of from about 1% to about 5% by weight, based on the total weight of the composition. If the amount of the biocidal agent is too low, negligible biocidal activity is obtained. Too high a concentration may affect adversely the container compatibility of the composition.

The lubricant composition should be able to eliminate or at least control the level of microbial contamination on the slats and undersides of the conveyor. The components of the lubricant composition and their respective amounts are selected to achieve a lubricant composition that gives at least a 5-log reduction in a BS3286 test with a contact time of 30 minutes. Typically, at least a 2-log reduction is achieved. Advantageously, the lubricant composition should be biocidal to at least pseudomonas bacteria such as Pseudomonas aeruginosa, which is capable of forming slime between the knuckles of the conveyor. This slime is unsightly, a source of unpleasant smell and potential source of product contamination. The lubricant composition typically should also be able to eliminate or at least control growth of yeast, mold and/or listeria. Yeast can be a problem in a brewery environment whereas listeria can be a problem in a diary environment.

The composition of the present invention may further comprise from about 1% to about 50%, typically from about 5% to about 40%, e.g., from about 10% to about 30%, by weight of a synthetic (i.e., non-soap) surfactant to enhance wetting, cleaning and/or lubricating properties. The compositions are non-soap based, and typically contain no fatty acid soap material, although minor amounts, e.g., less than about 2%, typically less than about 1%, by weight, may be tolerated. Anionic surfactants useful herein are described in U.S. Pat. No. 6,627,590 B1, issued Sep. 30, 2003, incorporated herein by reference. Suitable anionic surfactants typically have a hydrophobic chain containing from about 8 to about 18, typically from about 12 to about 18, carbon atoms and a sulfate, sulfonate or carboxylate group. Alpha olefin sulfonate surfactants are commonly used. Alkali metal, e.g., sodium and potassium, salts are particularly useful herein. Useful materials are sold under the trade names Rhodacal LSS-40-A, available from Rhodia Inc., and Calsoft AOS, available from Pilot Chemical Company.

Nonionic surfactants useful herein include ethoxylated alcohols of the type $R_6$—$(OCH_2CH_2)_mCH_2$—OH in which $R_6$ is a $C_6$ to $C_{20}$ alkyl group, e.g., a $C_{12}$-$C_{18}$ alkyl group, and m is in the range of from 1 to 5, typically from 2 to 20 . The value of m is selected in accordance with the intended final use of the lubricant composition. As m increases, the surfactant provides higher detergency but also more foam. Typically, the nonionic surfactant is present in the composition in an amount of up to about 20% by weight, e.g., from about 1% to about 10% by weight, based on the total weight of the composition. Synperionic A3 (sold by ICI—C.A.S. registry number 68213-23-0) is an example of a nonionic surfactant useful herein. This surfactant has a mixture of $C_{13}$ to $C_{15}$ alkyl groups and m is in the range 2 to 50.

As a further optional component, alcohols or polyols may be used to modify the viscosity of the composition. Examples include ethanol, isopropanol, glycerol, hexylene glycol,. polyethylene glycol, propylene glycol, sorbitol, and the like. Typically, isopropanol is used for this purpose, and may be present in an amount of up to about 20% by weight, typically from about 2% to about 15% by weight, based on the total weight of the composition.

Hydrotopes may also be present in the composition to impart stability. A typical hydrotope is urea, which may be present in an amount of about 15% by weight, based on the total weight of the composition.

Optionally, the composition further comprises a sequesterant such as EDTA. The sequesterant is useful in hard water areas to form complexes with metal ions such as calcium ions that may otherwise tend to precipitate components of the composition. The sequesterant is typically present in an amount of up to about 10% by weight, based on the total weight of the concentrate, e.g., up to about 5% by weight.

In one aspect, the invention provides a method for lubricating a conveyor track by applying to the track an effective amount of the above lubricant composition. The lubricant composition is typically sold in a concentrated form that is diluted in water, e.g., in the range of from about 0.1% to about 5%, typically about 0.2% to about 2% (volume/volume), during use in the plant. Of course, the pH of the concentrated composition typically increases as it is diluted with water. Water used for the dilution is generally soft or softened, but as mentioned above hard water may also be used. The dilution of the concentrate depends on factors such as the speed of the conveyor track, the type of package or container being carried by the track, the total loading on the conveyor track, and the amount of soiling caused by spillage.

The lubricant composition is applied to the surface of the conveyor track so that the surface of the conveyor does not become dry. This may be accomplished by passing the conveyor through a dip or trough containing a dilute solution of the lubricant, by brushing or roller coating the lubricant onto the surface of the conveyor, or by other conventional means. One method of application utilizes spray nozzles spaced along the conveyor track to ensure the proper degree of lubricity. No matter how the material is applied, it is important that the conveyor system remain consistently wet.

Dilution of the lubricant concentrate is normally performed at a central dispenser. The diluted lubricant composition is then typically pumped to spray nozzles at the point of use. There are some areas of the conveyor track that require very little lubricant. Typically, these are the zones before the filler and before the pasteurizer. In these regions secondary dilution is often employed. The lubricant composition is likely to be at its highest use concentration at the in-feed and discharge points of the rinser, filler, seamer, pasteurizer, and/or labeler. The lubricant composition is typically sprayed onto the conveyor from fan-jet nozzles placed at the start of each length of track. For particularly long runs, secondary spray jets may be positioned along the length of the track.

In areas of heavy soiling, it may be necessary to spray the lubricant composition onto the track continually. However, in most cases timers are employed to vary the dosing rate. Typically, on and off times will be between about 10 and about 90 seconds, and off times will not always equal on times. A final water wash jet may be placed at the end of a bottle/can filling track to wash lubricant residues from the container before crating. Excess lubricant is allowed to fall from the track to the floor or onto suitable drip trays.

The following non-limiting examples illustrate compositions of the invention useful for lubricating a conveyor track. All parts, ratios and percentages used herein are by weight unless otherwise stated.

| | Weight % | | | | |
|---|---|---|---|---|---|
| Ingredients | A | B | C | D | E |
| Water | 54.00 | 38.00 | 54.00 | 49.00 | 54.00 |
| Sodium benzoate | 2.00 | | 2.00 | 2.00 | 2.00 |
| Potassium benzoate | | 3.00 | | | |
| Isopropyl alcohol | 4.00 | 6.00 | 4.00 | 4.00 | 4.00 |
| Burcofac PA-1150 (1) | 15.00 | 20.00 | | 15.00 | 20.00 |
| Phosphate ester (2) | | | 20.00 | | |
| Rhodacal LSS-40-A (3) | 20.00 | 25.00 | | 20.00 | 20.00 |
| Calsoft AOS (4) | | | 15.00 | | |
| Phosphoric acid (75% sol. in water) | 5.00 | 8.00 | 5.00 | | |
| Glycolic acid | | | | 10.00 | |
| PH | 1.5 | 1.2–1.5 | 1.5 | 1.5–2 | 1.5–2 |

(1) Free acid of phosphate ester based on $C_9$ to $C_{14}$ linear primary alcohol, available from Burlington Chemical Company, Inc., Burlington, NC.
(2) T-Mulz D6 PE, available from Harcros Chemicals.
(3) Sodium $C_{14}$–$C_{16}$ alpha olefin sulfonate, available from Rhodia, Inc.
(4) Sodium $C_{14}$–$C_{16}$ alpha olefin sulfonate, available from Pilot Chemical Company.

The above compositions are made by adding water to a mixer, turning the mixer on, slowly adding the remaining ingredients in the order listed, and mixing the ingredients at room temperature for about 15 minutes.

What is claimed is:

1. A stable, non-precipitating, non-soap based lubricant composition for use in lubricating a conveyor track, said composition comprising, by weight:

(a) from about 5% to about 30% by weight of a phosphate ester of the formula $$R1\text{-}(OCH2CH2)n\text{-}O\text{—}P(O)(OH)_2$$

wherein n is from 0 to about 10, and $R_1$ is a $C_9$ to $C_{20}$ saturated or unsaturated alkyl group or a mixture of such alkyl groups;

(b) from about 40% to about 70% of water;

(c) from about 2% to about 15% of an acid selected from the group consisting of phosphoric acid and $C_1$-$C_6$ substituted or unsubstituted carboxylic acids;

(d) from about 10% to about 30% of an anionic synthetic surfactant; and (e) from about 1% to about 5% of a sodium or potassium benzoate biocidal agent; said composition having a pH of from about 1 to about 2.0; wherein the pH of the composition when diluted with water to a concentration of from about 0.1% to about 5% is less than 3.6, and wherein said composition does not form precipitates when contacted by acidic beverages washed from or spilled from containers moving on the conveyor track.

2. A composition according to claim 1 comprising from about 10% to about 20% of the phosphate ester and from about 3% to about 10% phosphoric acid.

3. A composition according to claim 2 having a pH of from about 1.5 to about 2.0.

4. A method for lubricating a conveyor track by applying to the track an effective amount of a stable, non-precipitating, non-soap based lubricating composition comprising, by weight:

(a) from about 5% to about 30% by weight of a phosphate ester of the formula $$R_1\text{—}(OCH_2CH_2)_n\text{—}O\text{—}P(O)(OH)_2$$

wherein n is from 0 to about 10, and $R_1$ is a $C_9$ to $C_{20}$ saturated or unsaturated alkyl group or a mixture of such alkyl groups;

(b) from about 40% to about 70% of water;

(c) from about 2% to about 15% of an acid selected from the group consisting of phosphoric acid and $C_1$-$C_6$ substituted or unsubstituted carboxylic acids;

(d) from about 10% to about 30% of an anionic synthetic surfactant; and (e) from about 1% to about 5% of a sodium or potassium benzoate biocidal agent; said composition having a pH of from about 1 to about 2.0; wherein the pH of the composition when diluted with water to a concentration of from about 0.1% to about 5% is less than 3.6, and wherein said composition does not form precipitates when contacted by acidic beverages washed from or spilled from containers moving on the conveyor track.

5. A method according to claim 4 wherein the composition has a pH of from about 1.5 to about 2.0.

6. A method according to claim 5 wherein the composition comprises phosphoric acid.

7. A method according to claim 6 wherein the anionic synthetic surfactant has a sulfate or sulfonate group.

8. A method according to claim 7 comprising from about 3% to about 10% of phosphoric acid.

9. A method according to claim 4 comprising from about 10% to about 20% of the phosphate ester.

10. A method according to claim 9 comprising about 3% to about 10% of phosphoric acid.

11. A composition according to claim 1, wherein $R_1$ is a $C_{10}$ to $C_{15}$ saturated or unsaturated alkyl group.

12. A composition according to claim 1 wherein n is from 0 to about 5.

13. A composition according to claim 1 comprising from about 3% to about 10% of phosphoric acid.

14. A composition according to claim 1 comprising from about 10% to about 20% of the phosphate ester.

15. A composition according to claim 1 wherein the anionic synthetic surfactant has a hydrophobic chain containing from about 8 to about 18 carbon atoms and a sulfate, sulfonate or carboxylate group.

16. A composition according to claim 15 wherein the anionic synthetic surfactant has a sulfate or sulfonate group.

* * * * *